United States Patent [19]

Doorenbos

[11] Patent Number: 4,942,988

[45] Date of Patent: Jul. 24, 1990

[54] DEVICE TO AID IN PUTTING ON ELASTIC HOSE

[76] Inventor: Daryl E. Doorenbos, R.R. 2, Box 85A, LeMars, Iowa 51031

[21] Appl. No.: 332,486

[22] Filed: Apr. 3, 1989

[51] Int. Cl.[5] ..... A47J 51/06

[52] U.S. Cl. ..... 223/111; 223/112; 223/77

[58] Field of Search ..... 223/60, 61, 63, 66, 223/75, 77, 111, 112, 117, 118, 119

[56] References Cited

U.S. PATENT DOCUMENTS

| | | | |
|---|---|---|---|
| 1,315,096 | 9/1919 | Dieley | 223/111 |
| 2,903,170 | 9/1959 | Ahn | 223/111 |
| 3,604,604 | 9/1971 | Ahn | 223/111 |
| 3,727,812 | 4/1973 | Weiss | 223/111 |
| 3,853,252 | 12/1974 | Scianimanico | 223/111 |
| 4,066,194 | 1/1978 | Leland | 223/111 |
| 4,482,084 | 11/1984 | Beskin | 223/111 |
| 4,637,532 | 1/1987 | Doorenbos | 223/112 |
| 4,638,932 | 1/1987 | Keller | 223/111 |
| 4,651,909 | 3/1987 | Banting | 223/111 |
| 4,756,453 | 7/1988 | Pettit | 223/111 |

FOREIGN PATENT DOCUMENTS

| | | | |
|---|---|---|---|
| 458526 | 8/1949 | Canada | 223/77 |
| 2602200 | 7/1977 | Fed. Rep. of Germany | 223/111 |
| 2940038 | 4/1981 | Fed. Rep. of Germany | 223/111 |
| 2452908 | 12/1980 | France | 223/111 |
| 717012 | 10/1966 | Italy | 223/111 |
| 1442313 | 7/1976 | United Kingdom | 223/111 |
| 1562307 | 3/1980 | United Kingdom | 223/111 |

*Primary Examiner*—Werner H. Schroeder
*Assistant Examiner*—Diana L. Biefeld

[57] ABSTRACT

A device for spreading elastic stockings so that the user can more readily insert a foot and leg into the stocking. The device includes two looped ends to be inserted into the stocking. The loops are hinged together so that they can be moved from a closed position for insertion of the device into the stocking to a spread position in which the foot or leg is inserted into the stocking along side the loops. The hinge includes a slide which allows free movement in the closed position, but slides into a releasable locked engagement in the spread position.

6 Claims, 3 Drawing Sheets

DEVICE TO AID IN PUTTING ON ELASTIC HOSE

BACKGROUND AND SUMMARY OF INVENTION

This invention pertains to devices to ease the problem of putting on an elastic stocking. In that respect, it attempts to solve the same problem as was met by my previous patent Nos. 4,789,087 and 4,637,532. However, where those devices acted to spread the stocking all the way to the toe, the present invention deals with a more simple device to spread principally the body of the stocking.

The problem of putting on an elastic stocking, particularly for older and more feeble persons can be severe. For those who have trouble bending, or for whom the pulling action required to stretch open the stocking may be painful because of arthritis or similar disabling condition, such a problem may be nearly insurmountable.

My previous inventions described in the above cited patents have provided devices which will provide considerable relief. However, there seems to be some demand for a less complex device which will spread only the leg of the stocking and does not necessarily stretch the foot.

Therefore, I have now devised a mechanism by which principally the leg portion of the stocking is spread so that the leg of the user can readily be inserted into the stocking. The device is adapted to be readily inserted into the stocking, and includes handles which provide leverage to ease the force required to stretch open the stocking. A sliding hinge adapted to lock the parts of the device in the spread position provides for easy insertion of leg into the stocking and withdrawl of the device so that it can then be collapsed again for re-use.

DESCRIPTION

Figure 1:
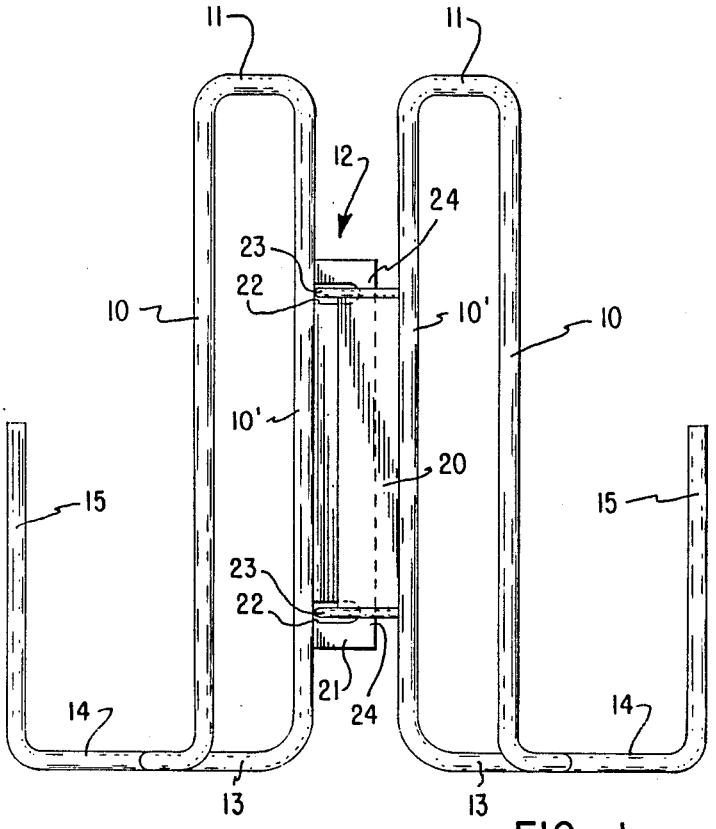
FIG. 1 is a side elevational view of the device of my invention in a spread position.

Briefly, my invention comprises a collapsing device for stretching an elastic stocking so that a user's foot and leg can be easily inserted into the stocking.

More specifically, and referring to the drawings, the stocking holder includes a pair of loops in the shape of an inverted "U" The loops are made of a relatively stiff material such as a metal rod. Each U Shape includes two upright legs 10 and 10' and a joining leg 11 forming what would be the bottom of the U-shape if it inverted. In use, the legs 10 and 10' stand substantially vertically and the joining leg 11 is substantially horizontal. The two legs 10' are joined together by a hinge 12, more completely described later.

Figure 2:
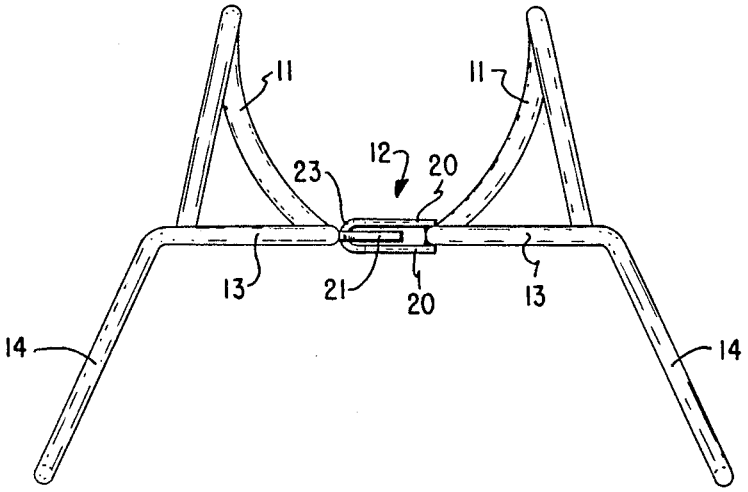
FIG. 2 is a bottom end view of the device as illustrated in FIG. 1.

At the bottom of the legs 10', I provide a horizontal bar 13 extending from the leg 10' which may be bent at an obtuse angle to provide an extension 14. The combination of the leg 13 and its extension 14 makes possible a relatively stable base on which the device can stand—particularly when the device is in the spread position as shown in FIGS. 1 and 2. A handle 15 may also be formed on the extension 14 by bending the bar in an upward direction.

Figure 5:
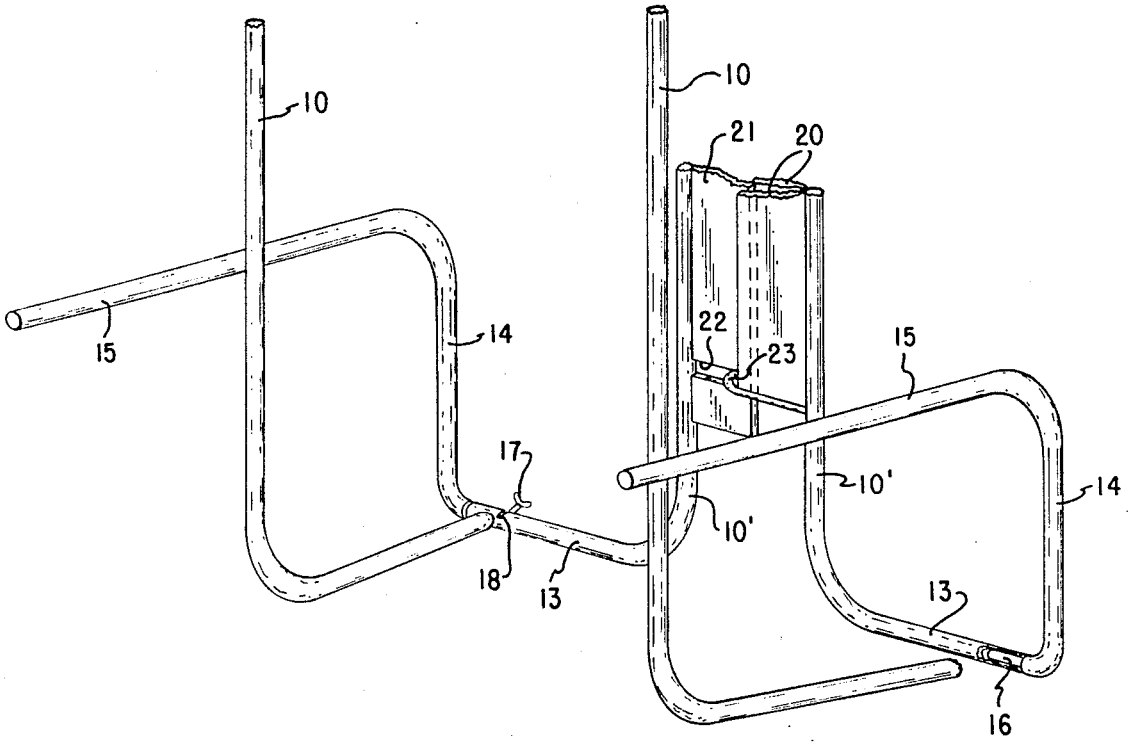
FIG. 5 is a perspective view of my device having pivoting handles and with the handles in their alternate position.

As best shown in FIG. 5, the extension 14 may be pivoted on the leg 13 so that the handle 15 can be turned to the position shown in that figure at about a right angle to the legs 10 and 10'. As will be described, this position is particularly useful when the stockings are being pulled onto the user's leg. The pivotal action may be accomplished simply by providing a smaller diameter tang 16 extending into a sleeve formed in the leg 13. A set screw 17 or other type of pin extending through a slot 18 formed in the sleeve part of the leg 13 and fixed in the tang 16 provides for limited rotation of the handles 15.

Figure 3:
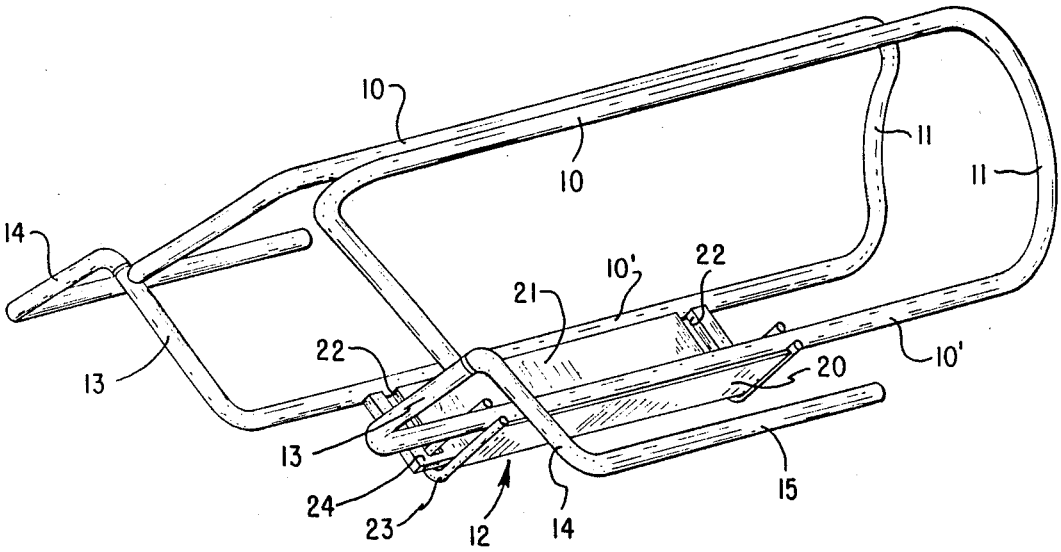
FIG. 3 is a perspective view of the device in a closed position.

The hinge 12 although allowing pivotting movement in the position shown in FIG. 3, is also adapted to prevent a pivotal motion in the position shown in FIGS. 1 and 2. This function is permitted by the structure of the hinge. The hinge is composed of a pair of plates 20 mounted on one leg 10' and spread apart in parallel relation. A single plate 21 is affixed to the opposite leg 10' in position to slide between the pair of plates 20.

Slots 22 cut into the single plate 21 receive wire loops 23 which are fastened to the pair of plates 20. The loops 23 extend beyond the plates 20 far enough to allow the remaining edge 24 on the single plate 21 left by the formation of the slot 22 to turn pivotally within the loop (see FIG. 3). Also, the plates 20 are narrow enough so as not to interfere with the pivotal turning allowed by the pivoting of the edge 24 within the loop 23.

Figure 4:
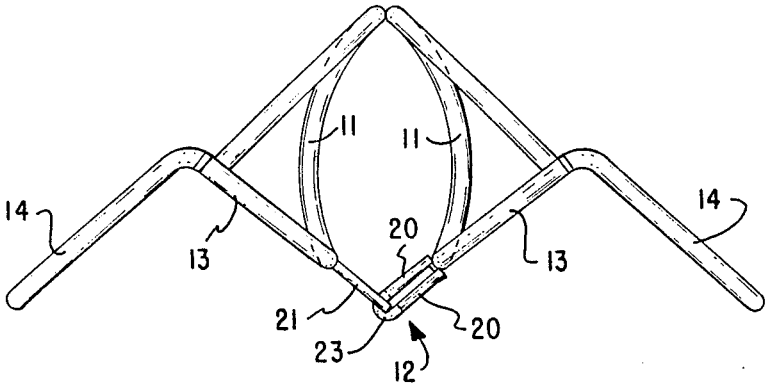
FIG. 4 is a view similar to FIG. 2 in a closed position.

Thus, when the plates 20 and 21 are slid apart (FIGS. 3, 4 and 5), the two parts of the device can be pivoted from the position shown in FIG. 5 to that of FIGS. 3 and 4. On other other hand, when the plate 21 slides between the plates 20 and the loop 23 slides through the slot 22 to the position shown in FIGS. 1 and 2, then the plates are slidably engaged and will not pivot.

Although the hinge described is my preferred embodiment, I conceive that by the use of splined devices on the legs 10' or other means more expensive than that described, a similar function could be achieved. The principal purpose is to provide a hinge that will prevent pivotal motion in one position but allow it under other circumstances.

To use my device, requires first that the elastic stocking be stretched over the supporting structure defined by the legs 10 and 10' and the joining member 11. With the device collapsed in the configuration shown in FIG. 3, the stocking is draped inside the enclosure within the framework formed by the legs, and then starting from the top of the stocking is turned inside out as it is stretched over that framework. Because the entire device can readily stand on a table or floor, supported by the leg 13 and extension 14 this process is not difficult.

When the foot of the stocking nears the upper part of the framework, the device is opened to the position shown in FIG. 5. This requires some force, but is aided by using the handles 15. In fact, I anticipate that for some users, it may be desirable to place the device on the floor and after a small initial spreading, to step on one handle 15 to press it toward the other handle which will be lying on the floor. As this is done, the hinge 12 will approach the position shown in FIG. 5, and as it does so, the angle plate 21 will slide between the pair of plates 20, thus locking the device in the open position. FIGS. 1 and 2 show the locked position.

In the locked position, the stocking is spread open so that insertion of the leg is relatively easy as the stocking is gradually slid off the legs 10 and 10' and onto the leg of the user. To assist in that function, the handles 15 can be pivoted to the position shown in FIG. 5 where they can be pulled on to pull the stocking upward onto the leg of the user.

Thus, the need for combined opening and pulling on of the stocking is avoided by the use of my mechanical stretching of the elastic. Simply pulling on the handles 15 of my device will allow the stocking to be properly put on.

Figure 6:
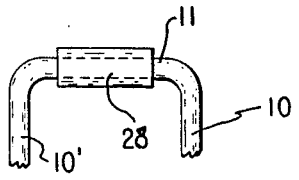
FIG. 6 is a partial view showing an alternative device to ease the movement of the stocking from the frame onto the leg of the user.

In some instances, it may be desirable to make easier the removal of the stocking from the framework formed by the legs 10 and 10' and the joining member 11. I have illustrated one such possible device in FIG. 6. Here, I provide a tube 28 formed preferably of a flexible plastic material. The tube is adapted to roll on the member 11 so as to allow the stocking to roll off the frame more easily than simply sliding off. Thus, the application of the stocking to the leg of the user is made even easier.

I claim as my invention:

1. An expanding device for stretching elastic members to ease putting such members onto the user comprising a pair of elongated frames adapted to receive said elastic members, the elongation of said frames being in a direction longitudinal of said device, hinge means affixed to each frame of said pair and hinged together on a longitudinal axis whereby said frames can be pivoted toward and away from each other, said hinge means being formed to releasably lock against pivotal action when said frames are in an open position away from each other, and extended handle means on each frame of said pair, said handles being adapted to provide leverage by which said frames can be moved away from each other to said open position.

2. The device of claim 1 in which said handles are pivotally mounted on said frames whereby said handles can be pivoted from a first position in which they extend the leverage available to move said frames to the open position to a second position where said handles are positioned to aid in pulling said frames over the part of the body to be enclosed by said elastic member.

3. The device of claim 1 in which roller means are rotatably mounted on each of said pair of frames whereby said elastic members will roll onto and off of said frames.

4. An expanding device for stretching elastic members to ease putting such members onto the user comprising a pair of frames adapted to receive said elastic members, hinge means affixed to each frame of said pair, said hinge means including pivotal means and locking means, said locking means being slidably engageable to releasably lock said hinge means in an open position, and said pivotal means being adapted to allow pivotal motion in all positions other than said locked position, and extended handle means on each frame of said pair of frames, said handles being adapted to provide leverage by which said frames may be separated from a closed position to an open position in which said elastic member is stretched open.

5. The device of claim 4 in which said locking means comprises a single plate on one member of said pair of frames, a pair of parallel plates on the second member, said pair of plates being spread apart to receive said single plate between them to lock said hinge means.

6. The device of claim 5 in which said hinge means includes loop means on said second member adapted to surround a part of said single plate to provide a pivoting means, said loop being adapted to slide relative to said single plate whereby said single plate can be moved into or out of engagement between said pair of plates.

* * * * *